US009509109B2

(12) United States Patent
Pocrass

(10) Patent No.: US 9,509,109 B2
(45) Date of Patent: Nov. 29, 2016

(54) COMBINATION RJ CONNECTOR AND FLASH CARD CONNECTOR

(71) Applicant: Alan L. Pocrass, Simi Valley, CA (US)

(72) Inventor: Alan L. Pocrass, Simi Valley, CA (US)

(73) Assignee: Alan L. Pocrass, Simi Valley, CA (US)

( * ) Notice: Subject to any disclaimer, the term of this patent is extended or adjusted under 35 U.S.C. 154(b) by 0 days.

(21) Appl. No.: 14/243,973

(22) Filed: Apr. 3, 2014

(65) Prior Publication Data

US 2014/0315406 A1 Oct. 23, 2014

Related U.S. Application Data

(60) Provisional application No. 61/854,159, filed on Apr. 18, 2013.

(51) Int. Cl.

| | |
|---|---|
| ***H01R 13/648*** | (2006.01) |
| ***H01R 27/02*** | (2006.01) |
| ***H01R 24/64*** | (2011.01) |
| *H01R 13/6581* | (2011.01) |

(52) U.S. Cl.

CPC ..... *H01R 27/02* (2013.01); *H01R 24/64* (2013.01); *H01R 13/6581* (2013.01)

(58) Field of Classification Search

CPC .. H01R 27/02; H01R 24/64; H01R 13/6581; H01R 27/00

USPC ..... 439/217, 79, 620.01, 541.5, 607.01

See application file for complete search history.

(56) References Cited

U.S. PATENT DOCUMENTS

| | | | | |
|---|---|---|---|---|
| 6,019,631 | A * | 2/2000 | Chen | H01R 13/514 439/541.5 |
| 8,485,843 | B2 * | 7/2013 | Chang | 439/541.5 |
| 2012/0129393 | A1 * | 5/2012 | Peng | H01R 27/02 439/607.01 |

* cited by examiner

*Primary Examiner* — Javaid Nasri
(74) *Attorney, Agent, or Firm* — The Webb Law Firm

(57) ABSTRACT

A combination connector includes a number of walls defining a housing and a female RJ connector and a female flash card connector inside the housing. Contact pins extend from contacts of the female RJ connector and contacts of the female flash card connector through at least one wall of the housing for connection to a PCB. The walls include electromagnetic interference (EMI) shielding.

15 Claims, 5 Drawing Sheets

COMBINATION RJ CONNECTOR AND FLASH CARD CONNECTOR

CROSS REFERENCE TO RELATED APPLICATION

This application claims priority from U.S. Provisional Application No. 61/854,159, filed Apr. 18, 2013, which is incorporated herein by reference.

BACKGROUND OF THE INVENTION

Field of the Invention

The present invention relates to a combination of one or more female RJ connector(s) and a female flash card connector in a common housing that can be mounted to a PCB. The female RJ connector(s) and the female flash card connector can be mounted one atop of the other or side by side in the common housing which can include shielding.

Description of Related Art

Modular connectors are commonly used for telephone systems, data networks, and low-speed serial connections. These connectors are inexpensive, relatively simple to terminate, and easy to plug and unplug. A modular connector typically has a clear, plastic body with the male plug including a tab for locking the male plug and female jack together when connected. In the vernacular used by the technology industry, these modular connectors are called "RJ" connectors. This is technically inaccurate, but the naming convention is widely used. RJ is an acronym for Registered Jack, which is part of a coding system developed in the 1970s by AT&T to classify telephone services and equipment. The coding system, called the Universal Service Order Code (USOC), used designations that began with the letters RJ to denote the capabilities of jacks in a building, and how they should be wired in order to connect to the public phone network.

A registered jack (RJ) is a standardized physical network interface, both jack construction and wiring pattern, for connecting telecommunications or data equipment to a service provided by a local exchange carrier or long distance carrier. The standard designs for these connectors and their wiring are named RJ11, RJ14, RJ21, RJ45, RJ48, etc. Many of these interface standards are commonly used in North America, though some interfaces are used world-wide.

A typical RJ connector includes an RJ socket housing (a.k.a. a female RJ electrical connector or jack) for insertion of an RJ male plug (a.k.a. a male RJ electrical connector) to form an electrical connection. RJ socket housings are available in many configurations including one port, multiple ports in a horizontal row, and stacked rows of RJ connectors.

MicroSD is a small removable flash memory card used mostly with mobile phones, tablets, laptop computers, and desktop computers to store data. It is the smallest flash memory card currently on the market. It measures just 5 mm×11 mm×0.7 mm making it ideal for mobile phone and tablet computer use. When users want to insert a MicroSD card into a MicroSD card connector they simply slide the MicroSD card into the MicroSD female flash card connector opening where the MicroSD card locks into place.

Although MicroSD cards are actually very small they can store large amounts of data. MicroSD cards are available with storage capacities ranging from 128 MB up to 8 GB, using a storage density of 34 GB/cm$^3$. There are different formats on MicroSD cards to store data, including an SDHC format.

SDHC stands for Secure Digital High Capacity. MicroSD cards formatted in the SDHC format provide higher storage capacity versus the same form factor as a normal MicroSD (or Secured Digital (SD)) card. SDHC cards first appeared in 2006. SDHC cards are generally formatted with the Fat32 file system. SDHC cards have a fixed sector size of 512 bytes.

The SD Card Association (SDA) has placed a limit of 32 GB on SDHC capacity, while technically speaking SDHC cards could support up to 2 terabytes (TB) of storage. SDHC cards emerging onto the market created considerable consumer confusion as normal SD cards, such as MicroSD cards, are used for many portable devices including digital cameras, camcorders, game systems, MP3 players and other electronic devices. SDHC cards are also graded by speed in three classes. Generally speaking, Class 2 offers 2 MB/s, Class 4 offers 4 MB/s and Class 6 offers 6 MB/s.

SUMMARY OF THE INVENTION

This invention combines a MicroSD card connector with a female RJ connector in a common housing. When the MicroSD card connector is combined with the female RJ connector in a common housing there is a saving of space on a substrate, e.g., printed circuit board (PCB), where the common housing is installed as a single unit verses installing a MicroSD card connector and a female RJ connector separately on the substrate.

The combination female MicroSD card connector and female RJ connector in a common housing disclosed herein can be mounted to a PCB in different manners depending on how contact pins from each connector are positioned in the common housing. The contact pins can extend at right angle and through a bottom wall of the common housing for insertion into through-holes in a PCB. Optionally the contact pins can be positioned horizontally to extend through a back or rear wall of the common housing for insertion into through-holes in a PCB. Conventional female RJ connectors and conventional MicroSD card connectors can be mounted in these different arrangements as well. The contact pins of these conventional connectors generally have symmetric orientation which minimizes the size of each connector. The symmetric orientation of the connectors in the common housing disclosed herein permits the smallest size possible to conserve space.

More specifically, disclosed herein is a female RJ connector and a female MicroSD card connector combined into a single (common) connector housing that can be attached to a PCB to save space and provide for the storage of data within a MicroSD card which can be inserted into the MicroSD card connector. The common housing can have shielding surrounding all or part of the female RJ Connector and the female MicroSD card connector. The female RJ connector and the female MicroSD card connector combine data storage with networking connectivity.

The female RJ connector and the female MicroSD card connector in a common housing combine the capabilities of the RJ connector for networking connectivity with that of the MicroSD card connector's storage of data on a MicroSD card. One application of this data storage in combination with the RJ connector is the accumulation of data pertaining to the status of the RJ connection when an RJ male plug is seated in the female RJ connector and data is being conveyed via this connection. This status data can include activity on the RJ connection including number of transmissions and number of Ethernet networking collisions. MicroSD cards are capable of holding large amounts of data which can be used to store files, folders, and any other information a user may want to store.

MicroSD cards which insert into the female MicroSD card connector are smaller than the dimensions of a standard female RJ connector opening and therefore the common housing can have a width and height and depth not much larger than the female RJ connector. Also or alternatively to a MicroSD card connector, standard USB, HDMI, and/or SATA connectors could be included in the common housing while maintaining the same height and size of the common housing.

The female RJ connector and any other connector described herein can be stacked one atop of each other in the housing, side by side within the housing, or, in the case where the housing encloses three or more connectors, the connectors can be stacked one atop of each other and side by side.

Also disclosed herein is a combination connector comprising: a plurality of walls defining a housing; a female RJ connector and a female flash card connector inside the housing; contact pins extending from contacts of the female RJ connector and contacts of the female flash card connector through at least one wall of the housing for connection to a PCB; and electromagnetic interference (EMI) shielding on one or more of the walls.

The walls can include top and bottom walls, right and left side walls extending between the top and bottom walls, a rear wall, and, optionally a front wall.

The female RJ connector and the female flash card connector can be positioned adjacent each other vertically or horizontally within the housing.

The housing can include in one of the plurality of walls, e.g., a front wall, a first opening configured to facilitate insertion of a male RJ connector into an opening of the female RJ connector, and a second opening configured to facilitate insertion of a flash card into an opening of the female flash card connector.

The combination connector can further include an integrated circuit (IC) chip in the housing. The IC chip can be operative for analyzing network transmission data on one or more contact pins of the female RJ connector and for storing said data in a memory of a flash card inserted in the female flash card connector.

The combination connector can further include an integrated circuit (IC) chip in the housing that can be operative for facilitating electrical connectivity between contacts of a male RJ connector and contacts of the female RJ connector when the male RJ connector is inserted into the female RJ connector. The IC chip can be further operative for collecting and storing connectivity data in a memory of a flash card inserted in the female flash card connector.

The female flash card connector can be a MicroSD connector and the flash card can be a MicroSD card.

The combination connector can further include a female USB connector in the housing and contact pins extending from contacts of the female USB connector through at least one wall of the housing for connection to a PCB.

The housing can include in one of the plurality of walls, e.g., a front wall, a first opening configured to facilitate insertion of a male RJ connector into the female RJ connector, a second opening configured to facilitate insertion of a flash card into the female flash card connector, and a third opening configured to facilitate insertion of a male USB connector into the female USB connector.

The female RJ connector, the female USB connector, and the female flash card connector can be positioned adjacent each other vertically, horizontally, or some combination of vertically and horizontally within the housing.

The combination connector can further include an integrated circuit (IC) chip in the housing. The IC chip can be operative for analyzing network transmission data on one or more contacts of the female USB connector, or on one or more contacts of the RJ connector, or on one or more contacts of the female USB connector and the female RJ connector. The IC chip can be further operative for storing said transmission data in a memory of a flash card inserted in the female flash card connector.

The combination connector can further include an integrated circuit (IC) chip in the housing. The IC chip can be operative for facilitating electrical connectivity between at least one of the following: contacts of a male USB connector and the contacts of the female USB connector when the male USB connector is inserted into the female USB connector; and contacts of a male RJ connector and the contacts of the female RJ connector when the male RJ connector is inserted into the female RJ connector.

The IC chip can be further operative for collecting and storing connectivity data in a memory of a flash card inserted in the female flash card connector.

The combination connector can further include a second female RJ connector in the housing and contact pins extending from contacts of the second female RJ connector and through at least one wall of the housing for connection to a PCB.

DETAILED DESCRIPTION OF THE INVENTION

The present invention will be described with reference to the accompanying figures where like reference numbers correspond to like or similar elements.

Figure 1:
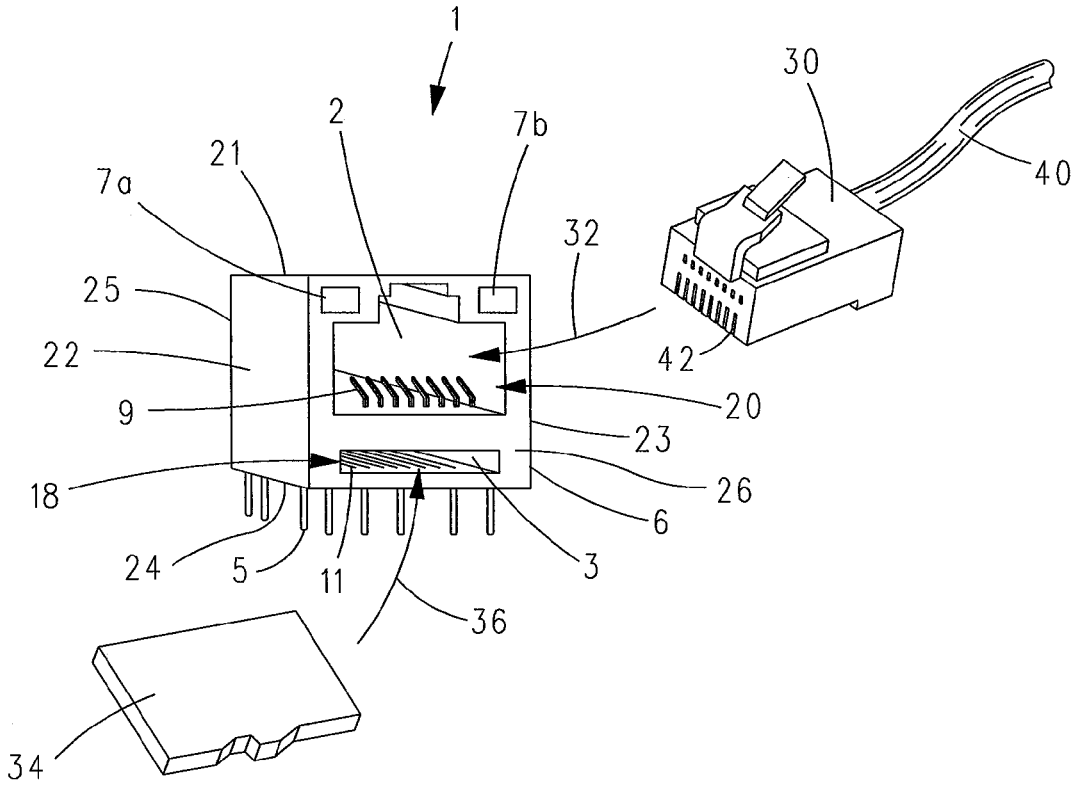
FIG. 1 is a perspective view of a combination female RJ connector and a female MicroSD card (reader/writer) connector in a common housing, including, in operative plug-in relation, a male RJ connector and a MicroSD flash memory card.
Figure 2:
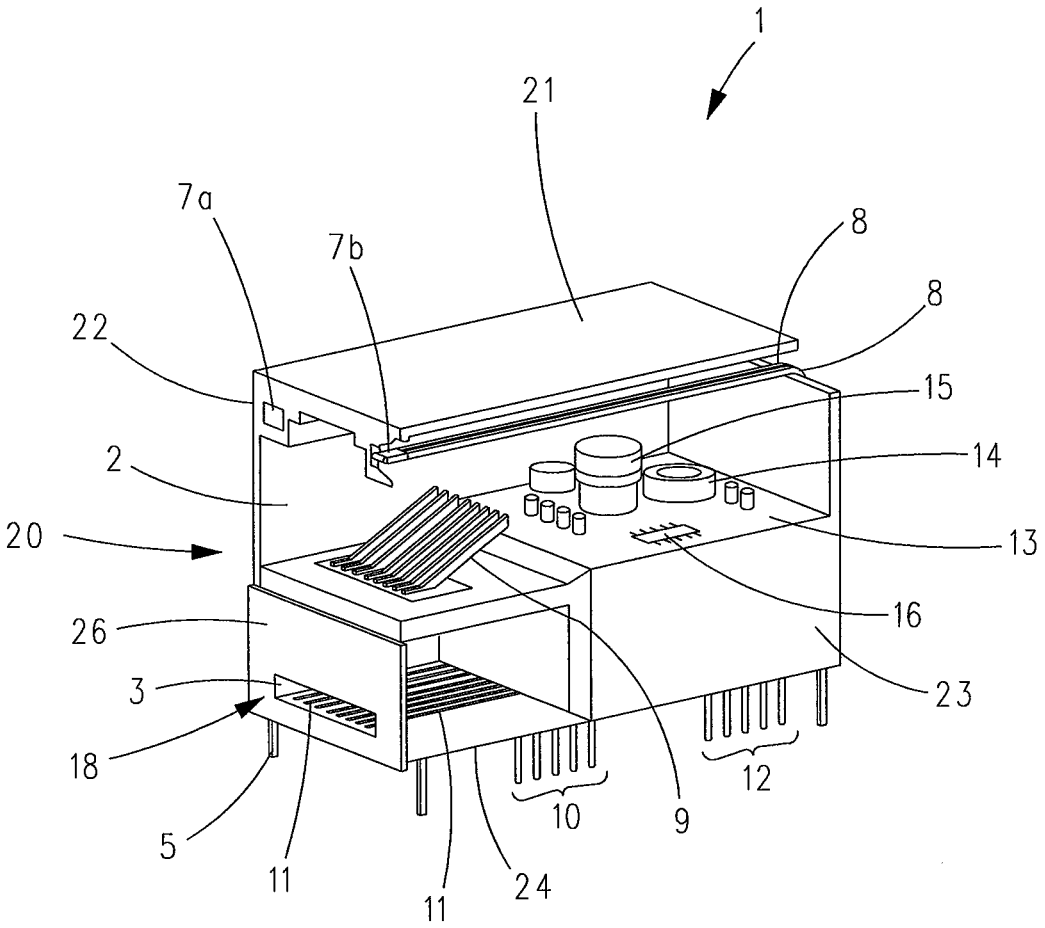
FIG. 2 is a partial cross-sectional perspective view of the combination female RJ connector and the female MicroSD card connector in the common housing of FIG. 1 that also houses magnetic components, a smart logic integrated circuit (IC) chip, and/or one or more LEDs.

With reference to FIGS. 1 and 2, a combination connector 1 includes a female RJ connector 2 and a MicroSD (flash) card (reader/writer) connector 3 in a common housing that includes a top wall 21, a right side wall 22, a left side wall 23, a bottom wall 24, a back wall 25, and a front wall 26. The female RJ connector 2 and the female MicroSD card connector 3 are located and contained within these walls. These walls optionally can be expanded to house other one or more additional connectors such as, without limitation, a USB connector, an HDMI connector, SATA connectors, and one or more additional RI Connectors 2.

FIG. 1 shows a male RJ connector 30 positioned to be plugged into female RJ connector 2 when moved in the direction of line 32 and a MicroSD flash card 34 positioned to be plugged into female MicroSD card connector 3 when moved in the direction of line 36. FIG. 1 also shows one or more optional LEDs 7*a* and 7*b* in the common housing, contacts 9 of female RJ connector 2, contacts 11 of MicroSD card connector 3, shielding 6 (e.g., on the outside of walls 21, 22, 23, 25, and, optionally, 24) and a shielding tab 5 coupled to shielding 6 for connection to a PCB. Shielding 6 can be made of any of a variety of conductive (e.g., metal) materials. Female RJ connector 2 and female MicroSD card connector 3 can be made from a variety of materials, such as, without limitation, plastic or metal. Under the control of IC chip 16 (discussed hereinafter) and/or an external controller (not shown), female MicroSD card connector 3 can be configured to write data to MicroSD card 34, read data from MicroSD card 34, or both, when MicroSD card 34 is inserted and seated in female MicroSD card connector 3.

The contacts 9 of RJ connector 2 connect to contact pins 10 which extend from female RJ connector 2 through one of the walls 21, 22, 23, 24, 25, e.g., bottom wall 24, to be mounted to a substrate, e.g., a PCB, by soldering, surface mount technology, press fitting, or other means of mounting connectors known in the art. Similarly, contacts 11 of MicroSD card connector 3 connect with contact pins 12 which extend from female MicroSD card connector 3 through one of the walls 21, 22, 23, 24, 25, e.g., bottom wall 24, to be mounted to the substrate by soldering, surface mount technology, press fitting, or other means of mounting connectors known in the art.

FIG. 2 shows a partial cross-section of the combination female RJ connector and female MicroSD card connector 1 in a common housing with optional integrated magnetic components 14, a smart logic integrated circuit (IC) chip 16 for data collection of connectivity status information, LEDs 7*a* and 7*b*, LED contact pins 8 connected to LED 7*b*, magnetic coils 15, and PCB 13. MicroSD contact pins 10 are in electrical contact with MicroSD internal contacts 11 which make contact with contacts (not shown) on MicroSD card 34 once it is completely inserted into the opening 18 of MicroSD connector 3. RJ connector cavity opening 20 of female RJ connector 2 includes RJ connector contacts 9 with spring function which are in electrical contact with contact pins 12. RJ connector internal contacts 9 make contact with contacts 42 of male RJ connector 30 when it is completely inserted into the RJ connector cavity opening 20 of female RJ connector 2.

The optional smart logic IC chip 16 facilitates the evaluation of network traffic on the contacts 9 of female RJ connector 2 when male RJ connector 30 with networking cable 40 attached thereto is inserted into female RJ connector 2. While a single smart logic IC chip 16 is described, the number of such IC chips is not to be construed as limiting the invention.

In an embodiment, IC chip 16 can be operative for analyzing network transmission data on one or more contacts 9 of female RJ connector 2 and for storing said analysis and any related data in a memory of MicroSD card 34 seated in female MicroSD card connector 3.

In another embodiment, IC chip 16 can be operative for facilitating electrical connectivity between contacts 42 of male RJ connector 30 and contacts 9 of female RJ connector 2. IC chip 16 can further be operative for collecting and storing connectivity data in a memory of MicroSD card 34 inserted into MicroSD card connector 3.

Figure 3:
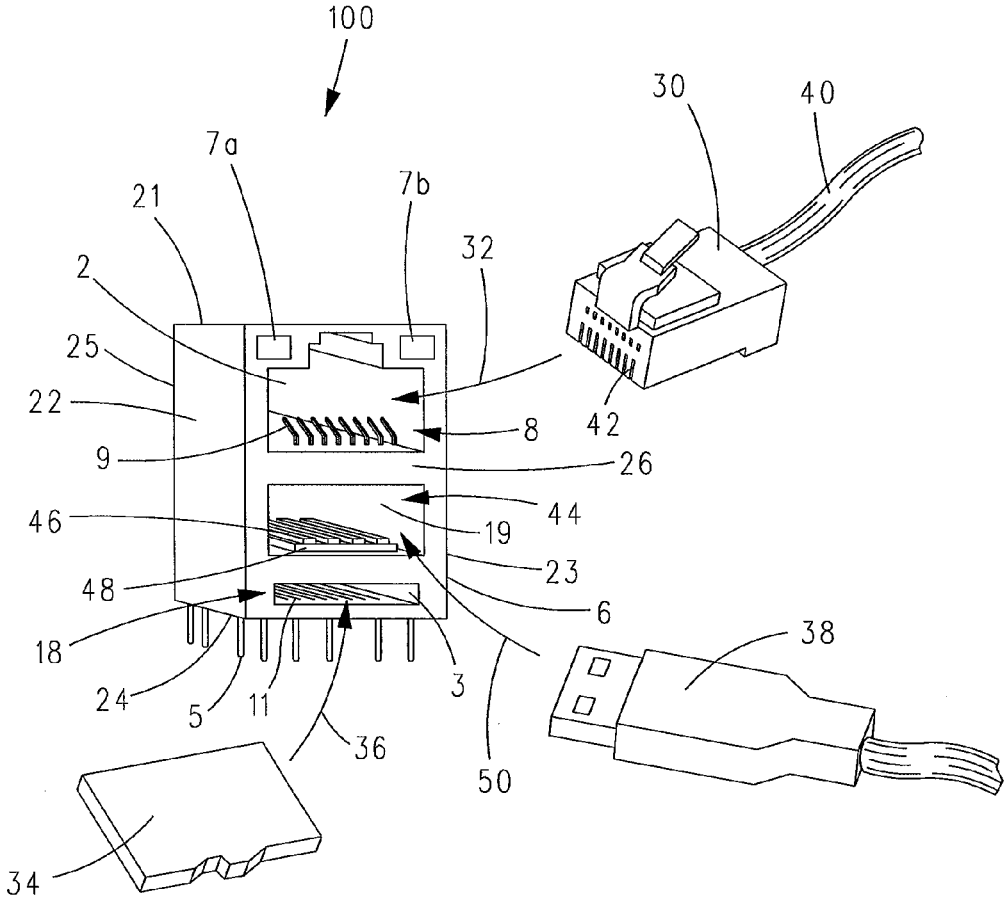
FIG. 3 is a perspective view of a combination female RJ connector, a female MicroSD card connector, and a female USB connector in a common housing including, in operative plug-in relation, a male RJ connector, a MicroSD card, and male USB connector.
Figure 4:
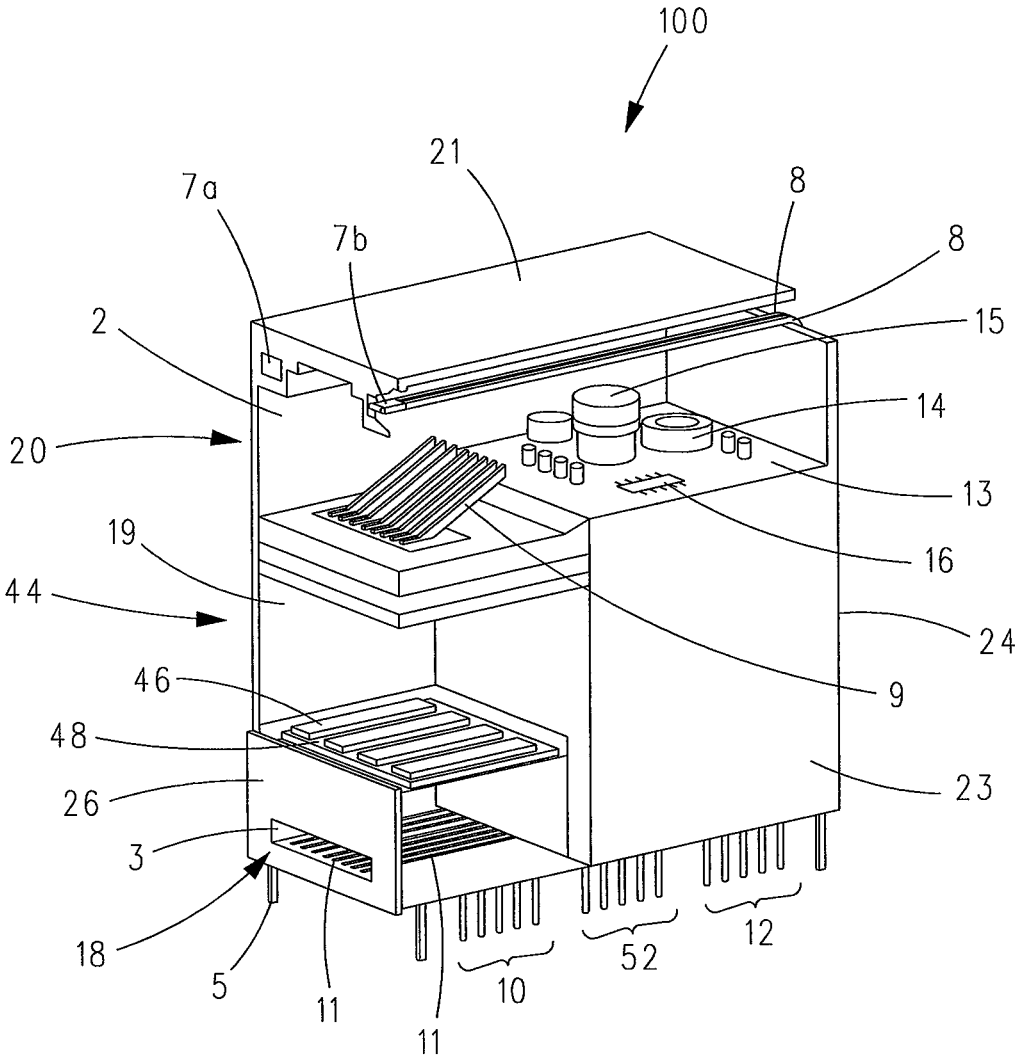
FIG. 4 is a partial cross-section of the combination female RJ connector, female MicroSD card connector, and female RJ connector in the common housing of FIG. 3 that also houses magnetic components, a smart logic integrated circuit (IC) chip, and one or more LEDs.

With reference to FIGS. 3 and 4 and with continuing reference to FIGS. 1 and 2, with some exceptions, another embodiment combination connector 100 is similar in many respects to combination connector 1 shown in FIG. 1. Some of these exceptions include connector 100 including a female USB connector 19 in addition to RJ connector 2 and MicroSD card connector 3. In order to facilitate the addition of female USB connector 19, the heights of walls 22, 23, 25, and 26 are increased (made taller) over like numbered walls of combination connector 1 shown in FIGS. 1 and 2.

Female USB connector 19 includes internal contacts 46 disposed on a PCB 48 which is positioned in the cavity 44 of female USB connector 19 to facilitate connection with mating contacts (not shown) of a male USB connector 38 when the male USB connector 38 is plugged into female USB connector 19 when moved in the direction of line 50. The internal contacts 46 of female USB connector 19 are in electrical contact with contact pins 52 which extend through female USB connector 19 through one of the walls 21, 22, 23, 24, 25, e.g., bottom wall 24, to be mounted to a substrate, e.g., a PCB, by soldering, surface mount technology, press fitting, or other means of mounting connectors known in the art.

The combination connector 100 in a common housing shown in FIGS. 3 and 4 can include optional integrated magnetic components 14, one or more magnetic coils 15, and/or a smart logic integrated circuit (IC) chip 16.

In the embodiment of combination connector 1 shown in FIGS. 1 and 2, magnetic components 14 and magnetic coils 15 are connected and operative for buffering electrical signals impressed on one or more contacts 9. In the embodiment of combination connector 100 shown in FIGS. 3 and 4, magnetic components 14 and magnetic coils 15 are connected to and operative for buffering electrical signals appearing on one or more contacts 9, one or more contacts 46, and/or some combination thereof.

In the embodiment of combination connector 1 shown in FIGS. 1 and 2, smart logic (IC) chip 16 facilitates the collection and, optionally, the analysis of data transfer occurring on one or more contacts 9 when male RJ connector 30 is inserted in female RJ connector 2, and for storing said analysis and/or collected data on MicroSD card 34 inserted in MicroSD card connector 3. In a similar manner, smart logic (IC) chip 16 in the combination connector 100 shown in FIGS. 3 and 4 facilitates the collection and, optionally, the analysis of data transfer occurring on one or more contacts 9 and/or one or more contacts 46, and the storage of said analysis and/or collected data on MicroSD card 34 inserted in MicroSD card connector 3 of combination connector 100.

Figure 5:
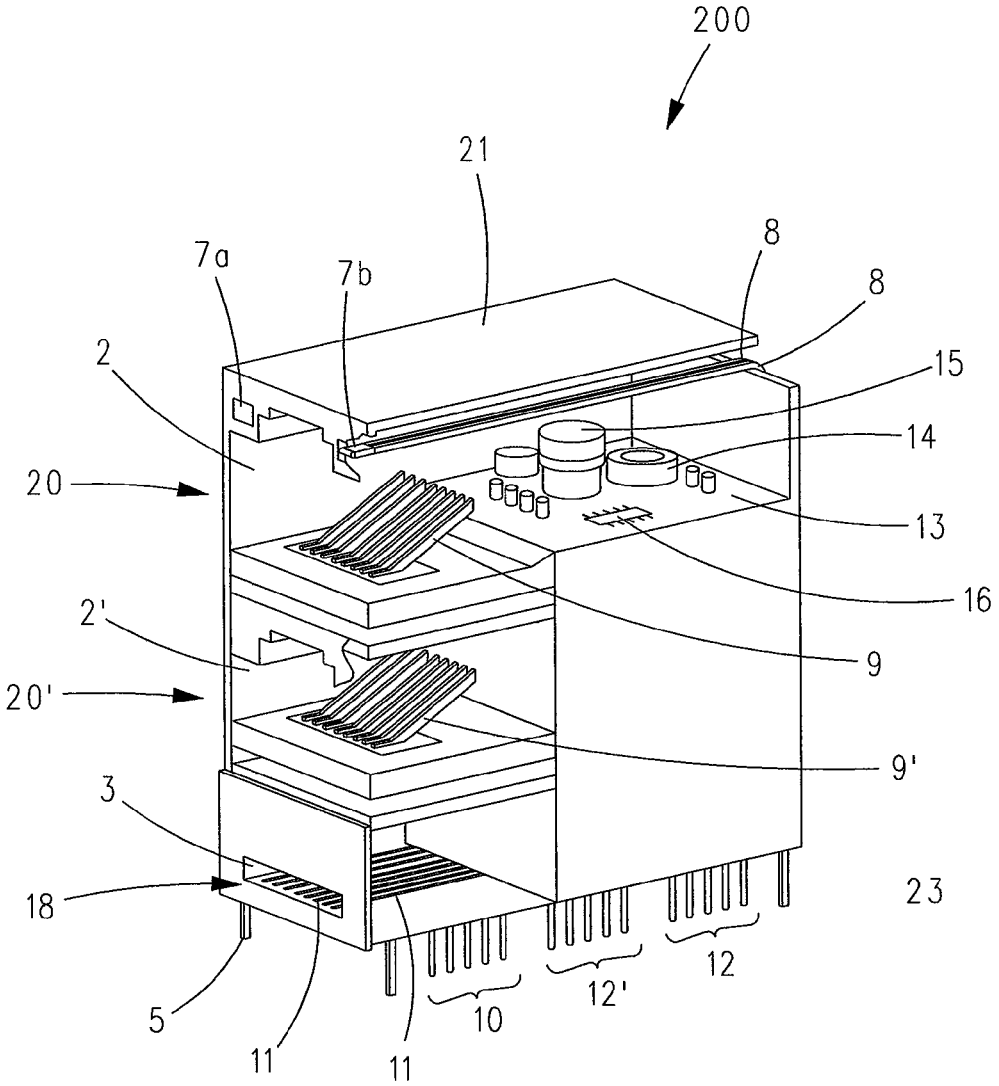
FIG. 5 is a partial cross-section of a combination first female RJ connector, second female RJ connector, and a female MicroSD card connector in a common housing.

With reference to FIG. 5 and with continuing reference to FIGS. 3 and 4, with some exceptions, another embodiment combination connector 200 is similar in many respects to combination connector 100 shown in FIGS. 3 and 4. Some of these exceptions include connector 200 including a second female RJ connector 2' in replacement of the female USB connector 19 in combination connector 100. This second RJ connector 2' is in addition to RJ connector 2 and MicroSD card connector 3. Female RJ connector 2' includes internal contacts 9' with spring function which are in electrical contact with contact pins 12' which extend from the female cavity of female RJ connector 2' through one of the walls 21, 22, 23, 24, 25, e.g., bottom wall 24, to be mounted to a substrate in any manner known in the art.

In the combination connector 200 shown in FIG. 5, magnetic components 14 and/or magnetic coils 15 are connected to and operative for buffering electrical signals appearing on one or more contact pins 9 and/or 9'. Smart logic IC chip 16 facilitates the collection and, optionally, the analysis of data transfer occurring on one or more contacts 9 and/or 9', and the storage of said analyzed and/or collected data on MicroSD card 34 inserted in MicroSD card 3 of combination connector 200.

The present invention has been described with reference to the accompanying figures. Obvious modifications and alterations will occur to others upon reading and understanding the preceding detailed description. It is intended that the invention be construed as including all such modifications and alterations insofar as they come within the scope of the appended claims or the equivalents thereof.

The invention claimed is:

1. A combination connector comprising:

a plurality of walls defining a housing;

a female RJ connector and a female flash card connector inside the housing, wherein the female flash card connector is configured to receive a flash memory card inserted therein;

contact pins extending from contacts of the female RJ connector and contacts of the female flash card connector through at least one wall of the housing for connection to a printed circuit board; and electromagnetic interference (EMI) shielding on one or more of the walls.

2. The combination connector of claim 1, wherein the plurality of walls include top and bottom walls, right and left side walls extending between the top and bottom walls, and a rear wall.

3. The combination connector of claim 1, wherein the female RJ connector and female flash card connector are positioned adjacent each other vertically or horizontally within the housing.

4. The combination connector of claim 1, wherein the housing includes in one of the plurality of walls:

a first opening configured to facilitate insertion of a male RJ connector into the female RJ connector; and a second opening configured to facilitate insertion of the flash memory card into the female flash card connector.

5. The combination connector of claim 1, further comprising an integrated circuit (IC) chip in the housing, said IC chip operative for analyzing network transmission data on one or more contact pins of the female RJ connector and for storing said data in a memory of the flash memory card inserted in the female flash card connector.

6. The combination connector of claim 1, further comprising an integrated circuit (IC) chip in the housing, said IC chip operative for facilitating electrical connectivity between contacts of a male RJ connector and the contacts of the female RJ connector when the male RJ connector is inserted into the female RJ connector.

7. The combination connector of claim 6, wherein the IC chip is further operative for collecting and storing connectivity data in a memory of the flash memory card inserted in the female flash card connector.

8. The combination connector of claim 1, wherein the female flash card connector is a MicroSD connector.

9. The combination connector of claim 1, further including:

a female USB connector in the housing; and contact pins extending from contacts of the female USB connector through at least one wall of the housing for connection to a printed circuit board.

10. The combination connector of claim 9, wherein the housing includes in one of the plurality of walls:

a first opening configured to facilitate insertion of a male RJ connector into the female RJ connector;

a second opening configured to facilitate insertion of the flash memory card into the female flash card connector; and a third opening configured to facilitate insertion of a male USB connector into the female USB connector.

11. The combination connector of claim 9, wherein the female RJ connector, the female USB connector, and the female flash card connector are positioned adjacent each other vertically, horizontally, or some combination or vertically and horizontally within the housing.

12. The combination connector of claim 9, further comprising an integrated circuit (IC) chip in the housing, said IC chip operative for analyzing network transmission data on one or more contact pins of the female USB connector, or on one or more contact pins of the RJ connector, or on one or more contact pins of the female USB connector and the female RJ connector, wherein said IC chip is further operative for storing said transmission data in a memory of the flash memory card inserted in the female flash card connector.

13. The combination connector of claim 9, further comprising an integrated circuit (IC) chip in the housing, said IC chip operative for facilitating electrical connectivity between at least one of the following:

contacts of a male USB connector and the contacts of the female USB connector when the male USB connector is inserted into the female USB connector; and contacts of a male RJ connector and the contacts of the female RJ connector when the male RJ connector is inserted into the female RJ connector.

14. The combination connector of claim 13, wherein the IC chip is further operative for collecting and storing connectivity data in a memory of the flash memory card inserted in the female flash card connector.

15. The combination connector of claim 1, further including:

a second female RJ connector in the housing; and contact pins extending from contacts of the second female RJ connector and through at least one wall of the housing for connection to a printed circuit board.

* * * * *